United States Patent [19]

Bewersdorf et al.

[11] 4,177,982

[45] Dec. 11, 1979

[54] SHEET FEEDERS

[75] Inventors: Elmer Bewersdorf, Downers Grove; James F. Cosgrove, Western Springs; Thomas R. Flavin, Mokena; Edward Gallagher, Oak Lawn; William B. McCain, Hinsdale; Ronald W. Weller, Oak Lawn; Lawrence J. Werstler, Evergreen Park, all of Ill.

[73] Assignee: McCain Manufacturing Corporation, Chicago, Ill.

[21] Appl. No.: 771,657

[22] Filed: Feb. 24, 1977

[51] Int. Cl.[2] ..... B65H 5/22

[52] U.S. Cl. ..... 271/5; 271/6; 271/8 A; 271/30 A; 271/94; 271/151

[58] Field of Search ..... 271/3, 3.1, 5, 6, 8 A, 271/30 A, 225, 186, 174, 176, 149–151

[56] References Cited

U.S. PATENT DOCUMENTS

| | | | |
|---|---|---|---|
| 2,956,801 | 10/1960 | Coakley | 271/5 |
| 4,046,369 | 9/1977 | Kluge | 271/3.1 |
| 4,071,234 | 1/1978 | Schick | 271/91 |

*Primary Examiner*—Richard A. Schacher
*Attorney, Agent, or Firm*—Kinzer, Plyer, Dorn & McEachran

[57] ABSTRACT

Signatures fresh from the printing press are fed in a shingled stream toward and then dropped one by one into a hopper which may feed a gathering chain.

The signatures are "broken" (unstuck) by first stacking them edgewise on a horizontal support, shingling them in a constant stream by an unusual form of suction feed, bending the shingled stream and thereafter cascading the stream into the hopper.

32 Claims, 14 Drawing Figures

50
222
224
242
252
268
280
232
201A
200
255
266
296
298
286
226
40
228
242
246
248
282
230
270
256
278
276
258
266
292
226
242
246
242
262
288
264
223
222
50
240
200
201A
220
232
12
248
228
226
242
246
242
198
190
200
224
238
180
223
262
286
40
223
200
258
12
201A
200

252
50
N1
274
255
284
272
282
280
256
270
N2
274
268
54

SHEET FEEDERS

This invention relates to a sheet feeder which is adapted in particular to transfer freshly printed signatures, received from the press room, to a supply hopper associated with binder equipment. While the feeder may be used in the foregoing relation, it is not necessarily restricted to that particular use; it may also be used to feed signatures, or other sheet material, under any circumstance where it has heretofore been customary for an attendant, working at a sheet supply hopper, to joggle, fan or otherwise riffle previously stacked sheets. Since the advantages of the present invention are perhaps best explained and perceived from the standpoint of press room activity, that scene will serve as well as any to explain featuresof utility.

Signatures (which are folded sheets to be assembled in a book) may be gathered and then bound in book form by a saddle binder such as disclosed in McCain U.S. Pat. No. 3,087,721. The signatures are stacked in respective supply hoppers and are fed to a gathering "chain" moving past the hoppers, one signature being dropped atop another. As many as fifty or more hoppers may be involved, each feeding a different signature for one book, or there may be only two active hoppers. Equipment associated with the supply hopper itself may be controlled in unique ways: McCain U.S. Pat. Nos. 3,565,422, 3,589,712 and 3,608,893.

As mentioned in McCain U.S. Pat. No. 3,589,712 it is customary for an attendant to keep the supply hoppers full with makeup additions. It is necessary that the signatures be joggled by the attendant so they will not stick as the result of friction, static electricity and fresh ink.

Signature machines may be located in a bindery area near the press room where the signatures are printed, or perhaps in an adjacent building. The printed matter, fresh from the press, is stacked in the press room (either bundled or not bundled) and delivered to the bindery by carts and the like where the aforementioned attendant takes over.

Time-and-motion studies reveal a wide spectrum of a sense of responsibility on the part of such attendants. Some work is superior, some is slovenly; and even the best worker can get behind or err when trying to "break" (fan, riffle and so on) the stacked signatures as an incident to assuring loose association in the signature machine supply hoppers. One study showed that machine stoppage was due to human error (as was suspected) and not attributable to machine failure. Also, as much time, if not more, is required to riffle the sheets as to merely load the hopper.

The primary object of the present invention is to increase productivity in the area involved (to eliminate error and careless work) and to do this by apparatus which automatically loosens and riffles the sheets and which automatically loads the hopper, thereby eliminating the time spent by an attendant in doing this.

Under the present invention, as will be seen, an attendant is required to handle the press room product, loading the sheet into the apparatus at a supply station. This does require labor but of course no labor is required for the tasks which are eliminated. In this connection, another object of the invention is to automatically extract the sheets one by one from the stack at the supply station while maintaining a constant uniform stream or flow of sheets and to accomplish this in a specific manner which indeed assures only one sheet (signature) at a time is extracted and fed in an overlapping relation with the preceeding one, specifically by the action of an endless stripper belt which grips the sheet by suction.

Signature sheets vary from the standpoint of strength, friction (high gloss vs. newsprint) and dimension. The conditions which produce a uniform stream for one kind of signature are not necessarily those for another. We have found that by being able to alter the condition of the supported stack at the supply station and by being able to select the part of the sheet, downward from the upper edge, where the suction grip is applied for extracting the sheet, it is possible to handle a wide variety of signature quality and the accomplishment of this is another object of the invention.

The feature of accommodation, that is, one standard machine being able to accommodate various kinds of signatures, is extremely important because a book itself may vary as to signature quality. A good example is a magazine which may have several kinds of so-called mailing inserts of a quality quite different from the remainder. Under the present invention the feeder apparatus which feeds one hopper may be adjusted to feed signatures of one quality while the adjacent one is adjusted for another quality. In this same connection, additional objects of the invention are to so construct the feeder apparatus that it may be easily loaded at one end and adjusted to handle signatures of different dimension, both to vary the overlap and to vary the height from which signatures are dropped into the hopper after being riffled (flexed) in the course of stream feeding.

Another object of the invention is to so construct and orient the path of stream feeding that the signatures in their flight to the hopper are flexed (bent) in different directions, resulting in sliding, jostling or riffling.

In the Drawing

GENERAL DESCRIPTION

Figures 1A, 4:
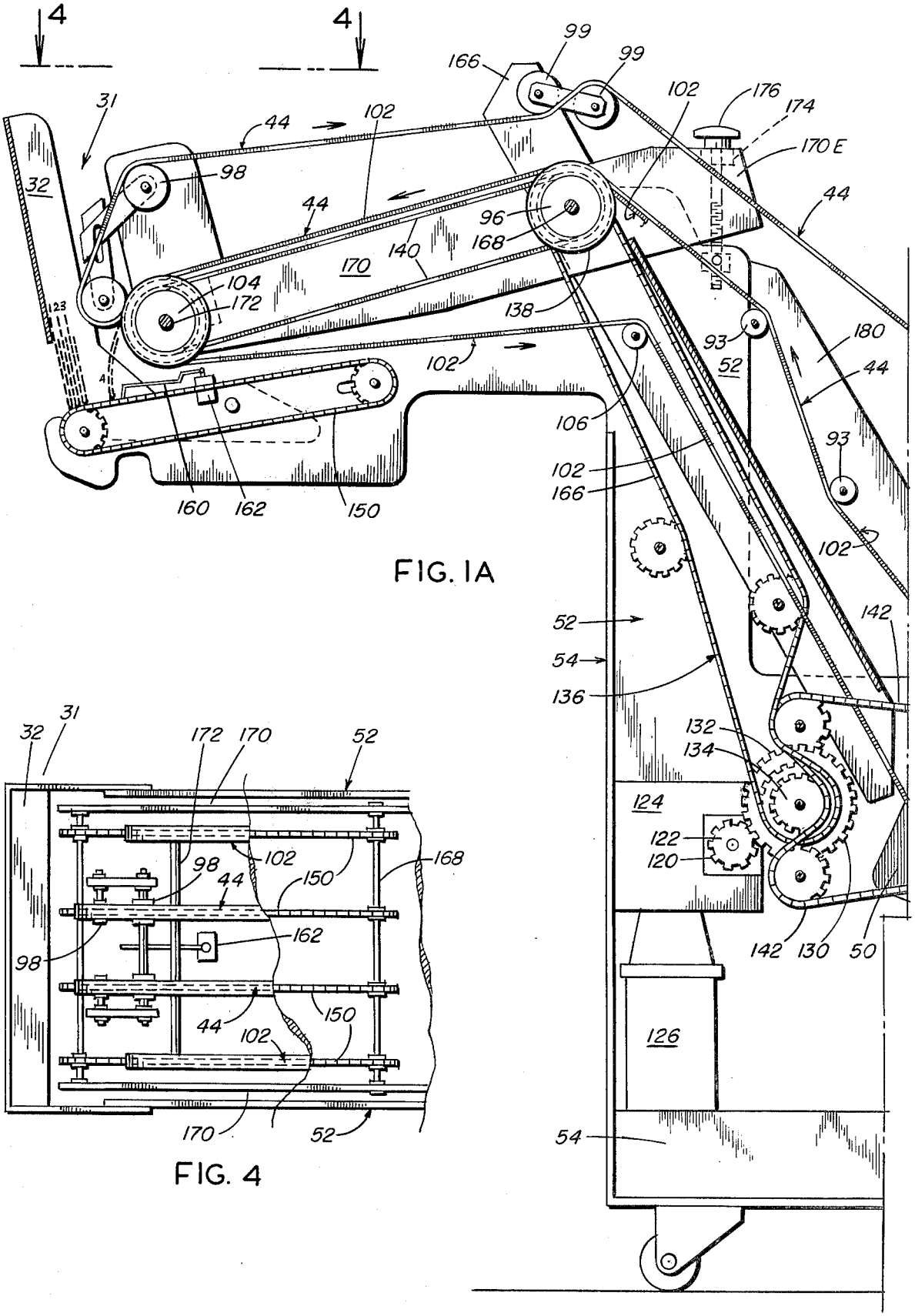
FIGS. 1A and 1B are side elevation views of the machine of the present invention taken on the lines 1A1B—1A1B of FIG. 2.
FIG. 4 is a fragmentary plan view, partly broken away, showing features of the hopper, taken on the line 4—4 of FIG. 1A.
Figure 1B:
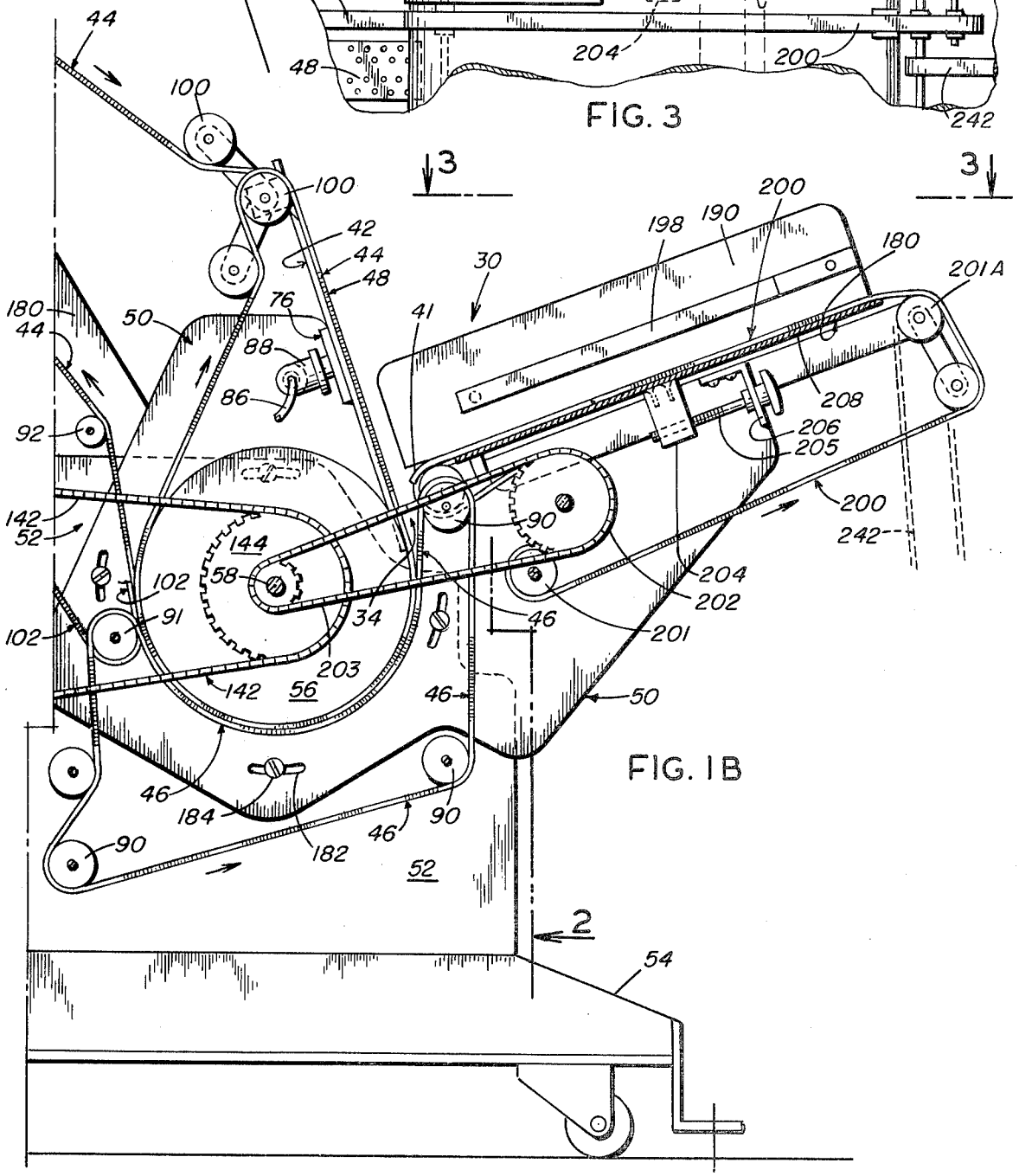
Figure 5:
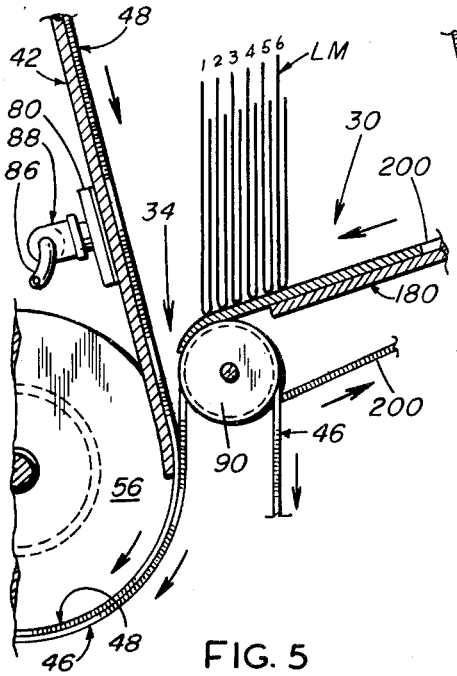
FIG. 5 is a detail view of the gate and first riffle bend.

The machine of the present invention is adapted to transfer signatures from a supply station 30, FIG. 1B, to a delivery station 31 characterized by a hopper 32, FIG. 1A. The signatures will be stacked on edge at the supply station as shown in FIG. 5. The signatures are extracted one by one at the supply station and are fed in overlapped relation (FIG. 6) through a gate 34, FIG. 5. Shortly after being extracted and moved through the gate, the overlapped signatures are turned around a first riffle bend 36, FIG. 6, and are then elevated in overlapped relation, by means of transfer belts, to a second riffle bend 38, FIG. 7.

Figure 7:
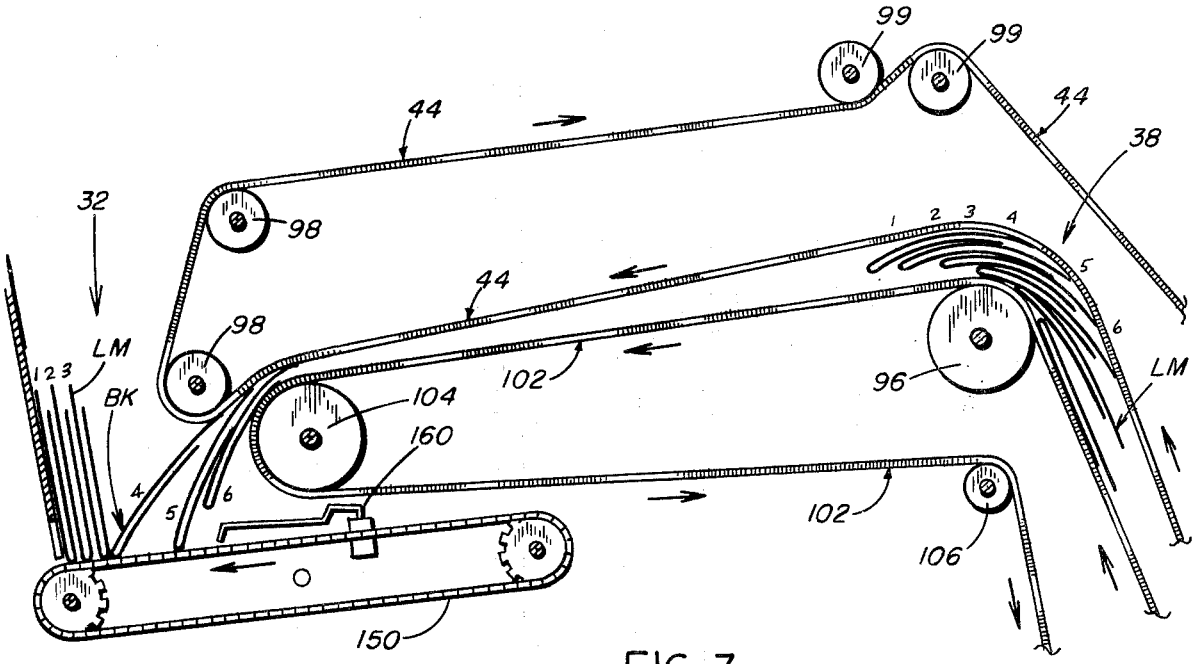
FIG. 7 is a detail view showing the second riffle bend and the way in which the hopper is loaded.

Forward of the second riffle bend, FIG. 7, the overlapped signatures move forward in a substantially horizontal path and are eventually dropped into the hopper 32 as shown in FIG. 7.

Once the machine is in operation there is a continuous stream of overlapped sheets extending from the gate 34, around the first riffle bend, upwards to the second riffle bend and forward to the delivery station 31, where the signatures are dropped one by one into the supply hopper.

Figures 11, 12:
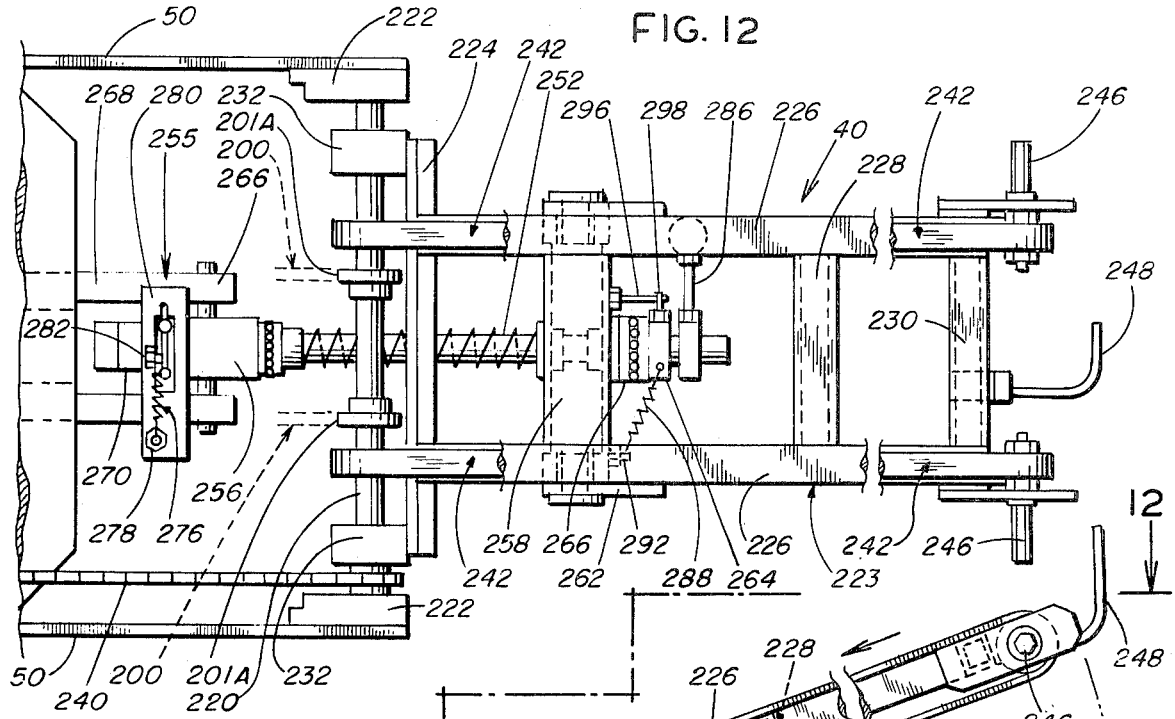
FIG. 11 is a side elevation at the supply station; showing details of a loader.
FIG. 12 is a plan view on the line 12—12 of FIG. 11.

A loader 40, FIG. 11, may be utilized to move bundles of signatures, received from the press room, from floor level to the level of the supply station.

The disclosure to follow will be addressed, successively, to the manner in which the signatures are fed through the gate, the manner in which the signatures are thereafter riffled, the way the hopper is loaded, and finally the means used to load the supply station and to enable the supply station to be adjusted for handling signatures of variant size and quality.

Gating the Signatures

Figure 6:
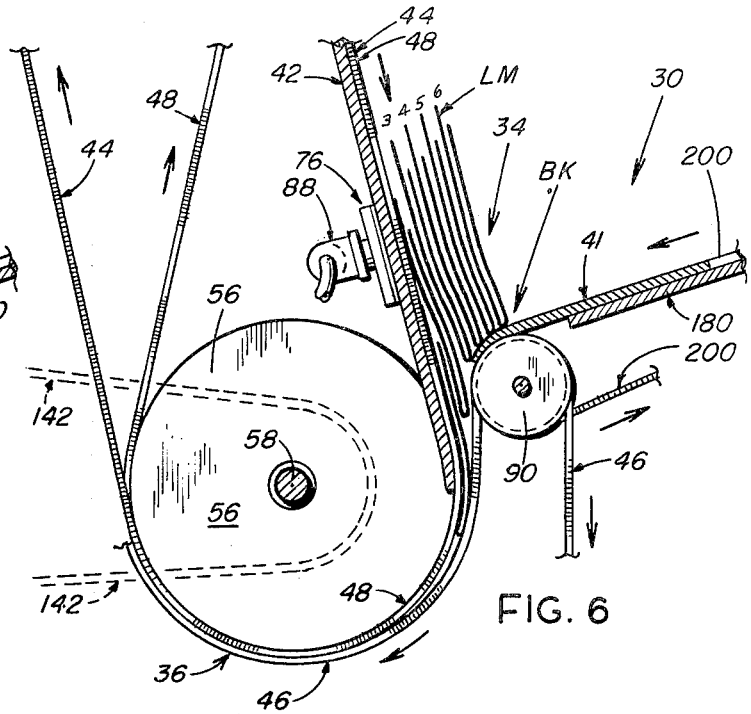
FIG. 6 is an enlarged view of the gate and riffle bend, showing the manner in which overlap is achieved.

The gate 34 at the front of the supply station 30, FIG. 1B, is defined by the separation between a downwardly inclined guide plate 41 and a substantially upright stop plate 42. The signatures to be fed through the gate are stacked in the supply station edgewise with the backbone, BK (the fold in the signature) downward, as shown in FIG. 6. Usually signatures are folded off-center resulting in an extended edge known as the "lap margin", identified by reference character LM, FIG. 6. This aids in following the path of the signatures as will be seen.

The forwardmost signatures in the supply stack are extracted successively and fed into the gate in a manner shortly to be explained. As this occurs, the backbone of the signature, in leading position, is clamped between opposed pairs of feed belts 44 and 46, FIG. 2. The feed belts 46 are also shown in FIG. 1B.

The signatures are extracted by endless stripper belts 48 which are effective to apply suction to the face of the leading signature in the supply stack leaning against the stop plate 42.

Figure 2:
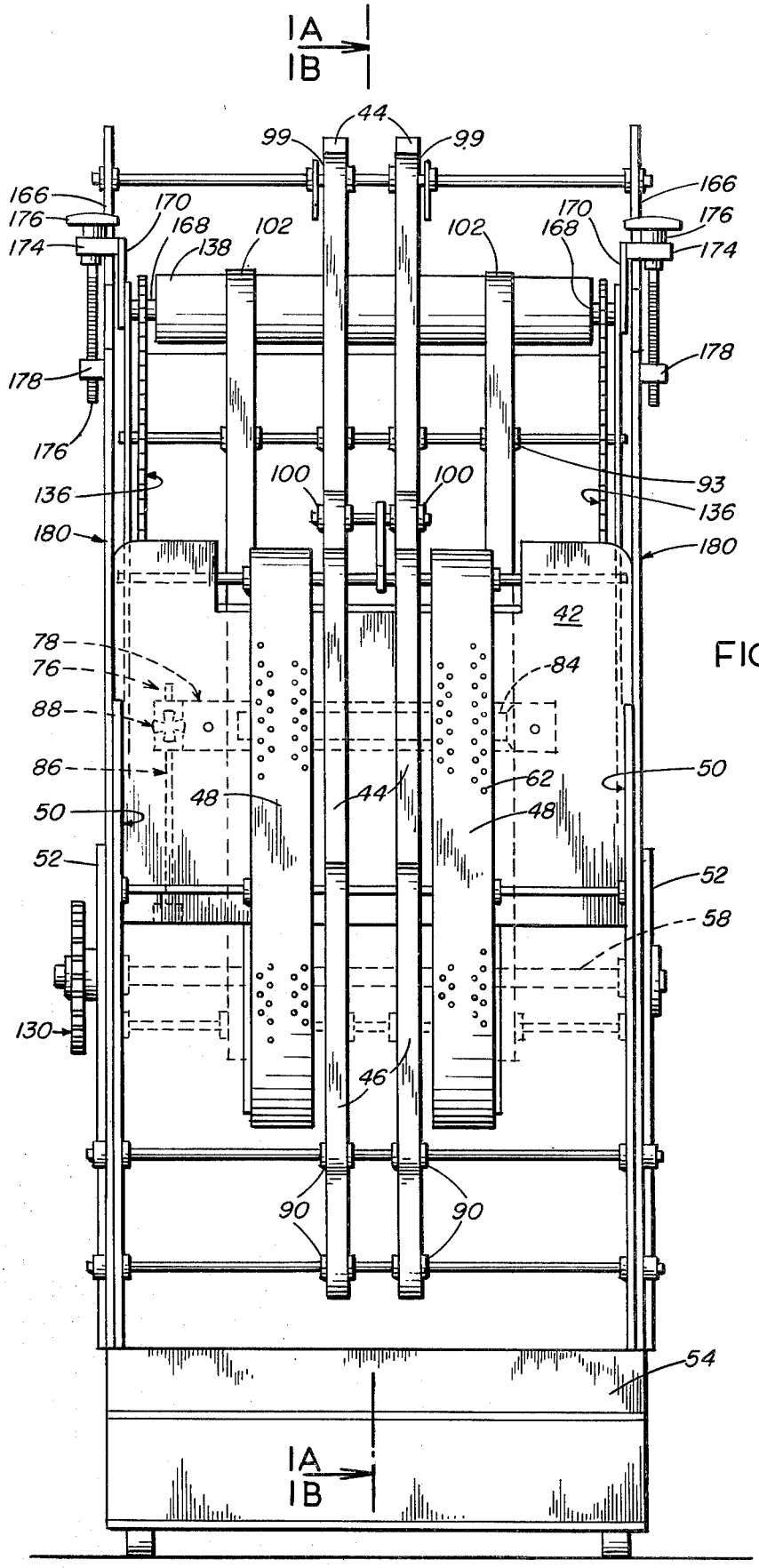
FIG. 2 is an end elevation of the machine.

The stop plate 42, as shown in FIGS. 1B and 2, is supported by and between a pair of side plates 50 which in turn are supported by a pair of upright support members 52 extending upward from the bed of the machine 54 which is floor mounted.

The feed belts 44, of which there are two, and the two stripper belts 48 as well, are driven by wheels or discs 56, FIG. 1B supported on an axle 58 driven by a chain.

Figure 8:
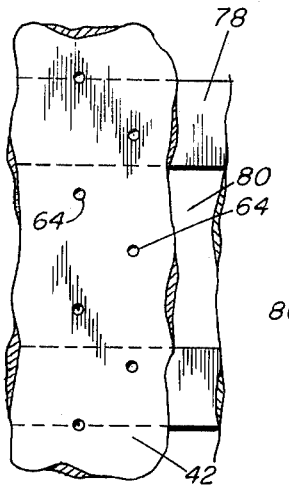
FIG. 8 is a fragmentary assembly view of the manifold and juxtaposed stop plate, on the line 8—8 of FIG. 9.
Figure 9:
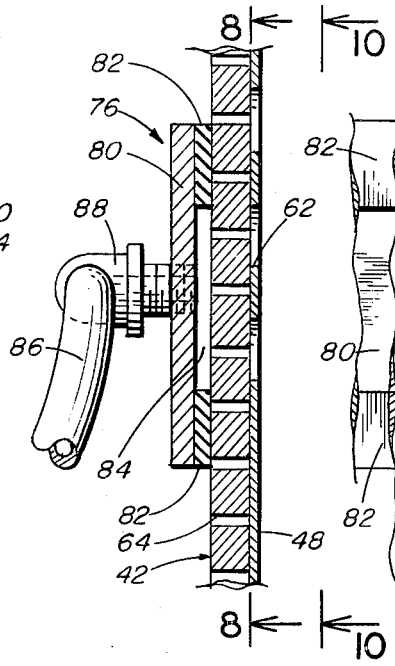
FIG. 9 is a sectional view of the manifold, stop plate and stripper belt, on the line 9—9 of FIG. 10.
Figure 10:
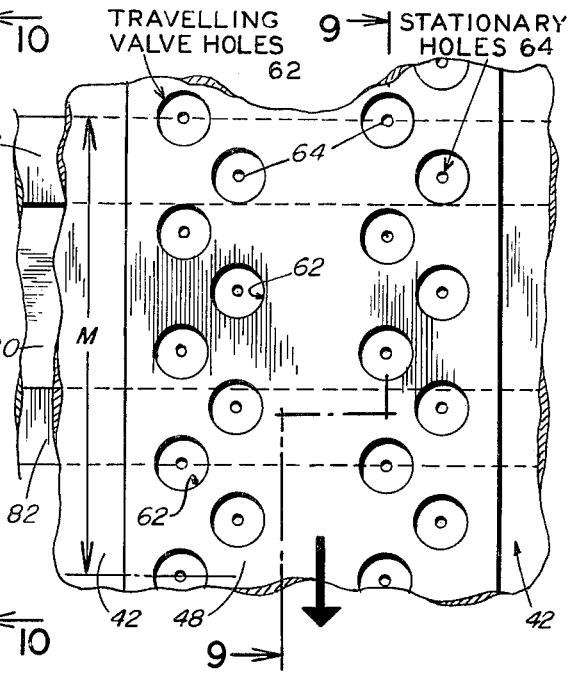
FIG. 10 is a fragmentary assembly view of the manifold, stop plate and one of the striper belts in valve-on position.

The stripper belts 48, as shown in FIGS. 2 and 10, are juxtaposed on and in contact with the stop plate 42. The stripper belts are provided with large openings 62, FIG. 10, and the stop plate 42 is formed with smaller openings 64 as best shown in FIGS. 8 and 9.

A manifold 76 is located at the back of the stop plate, FIGS. 1B and 9. The manifold is constructed in a simple fashion, comprising a flat plate 80 spaced from the back of the stop plate by a rectangular seal 82 having a large recess 84 which spans a substantial area at the back of the stop plate as best shown in FIG. 2. The seal 82 assures that negative pressure is maintained within recess 84.

The opening 64 in the stop plate are in repeated rows spread over an area of predetermined large extent behind each of the two stripper belts. The openings 62 in the stripper belts have the same center-to-center spacing as the stop plate openings but are of much larger diameter as already noted, FIG. 10.

Figure 10A:
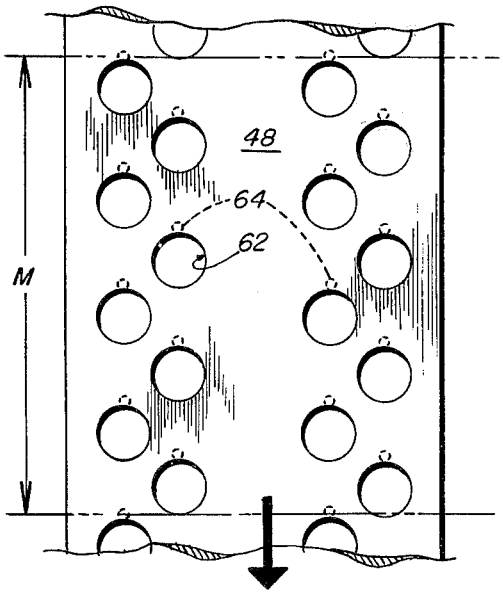
FIG. 10A is a view similar to FIG. 10 but in valve-off position.

The stripper belts 48 traverse the stop plate top-to-bottom and in doing so constantly disclose (FIG. 10) and close (FIG. 10A) the stop plate openings. Consequently, suction is repeatedly established and disestablished at the face of the stripper belts opposed to the supply stack. When vacuum is established, the frontmost signature (signature No. 2, FIG. 7) is pulled downward accordingly as the stripper belt openings 62 communicate suction thereto in the course of this downward increment of movement, advancing the signature into the gate 34. During the preceeding increment, the stripper belts feed signature No. 1 into the gate and during the following increment signature No. 2 will be grabbed by suction, extracted and advanced through the gate.

The manifold 76 is vertically adjustable. To this end, as shown in FIG. 2, the manifold plate 78 at one end may be mounted on a guide 86 and held in a predetermined position by a lock stud operated by a handle 88. This is so in order that a signature may be grabbed higher or lower, which also determines how much signature overlap prevails in the gate and subsequently as well. This can be visualized from FIG. 6 where it can be seen that by moving the manifold upward the vacuum grab on contact will be higher on the sheet and the overlap less, whilst by lowering the manifold downward the contact will be lower on the sheet and the overlap greater. The position of the manifold will vary accordingly as the signatures are more, or less, flexible and whether they are long or short. By the same token, more or less vacuum may be required. Vacuum is communicated from a source of negative atmospheric pressure (not shown) to a hose 86, FIG. 9, fastened to a fitting 88 threadedly mounted in the manifold plate 80.

It has already been mentioned the stripper belts 48 and feed belts 44 are mounted on driven co-axial wheels and that the belts 44 are opposed to another set of belts 46. Belts 44 and 46 are so arranged as to converge to form a bight immediately beneath the gate 34. Consequently as a signature is extracted and moved into the gate it is at the same time delivered to the bight of the feed belts 44 and 46.

Riffling The Signatures; The Chain Drive

The signatures which are trapped in the bight between the feed belts 44 and 46 are overlapped, just as they were overlapped in the course of movement into the gate 34, FIG. 6. The feed belts 46 are driven by virtue of being in contact with the wheels as 56 and indeed the amount of contact between the feed belts 46 and the wheels 56 is nearly 180° as can be seen in FIG.

1B, maintained by appropriately oriented guide rollers as 90 and 91 around which the feed belts 46 are played. Thus the overlapped signatures trapped between the belts 44 and 46 are turned approximately 180° after being extracted and in doing so are flexed and slid on one another which accounts for eliminating conditions which might cause the signatures to stick to one another.

The feed belts 46, FIG. 1B, are of endless form and have a relatively short run. In comparison the feed belts 44 have an exceptionally long run in that they are guided and supported to extend from the driven wheels 56 upward past a guide roller 92, FIG. 1B, past similar guide rollers 93, FIG. 1A, from thence over a pair of spaced driven wheels as 96, are reversed around guide rollers 98, then through a pair of tensioning rollers 99, FIG. 1A, whereafter the feed belts 44 are re-aligned to traverse the stop plate by means of tensioning rollers 100, FIG. 1B.

There are cooperating transfer belts opposed to the belts 44. Thus, as shown in FIG. 7, endless belts as 102 are in contact with the wheels as 96, extend forwardly and around a reversing wheel 104, and then are directed downwardly by a guide roller 106 to meet the guide rollers as 91 where they are reversed for the return or upward flight, being guided by the same rollers which guide the belts 44.

Thus, after the extracted signatures are turned around the wheels as 56 they are confined in the bight between the opposed belts 44 and 102 and are transferred upward to the driven wheels 96 where they are once again turned, approximately 90°, resulting in more bending and sliding which amounts to a second riffle.

A chain drive is employed to drive wheels 56 and 96. To this end a main driving gear 120, FIG. 1A, is driven through a normally engaged clutch 122 in turn coupled to a gear reducer 124 driven by a motor assembly 126. Clutch 122 is of known form and may be disengaged by energizing a solenoid, not shown.

Gear 120 is meshed with a larger gear 130 which drives two co-axial sprockets 132 and 134. Sprocket 132 drives a chain 136 which drives a sprocket 138 secured to the shaft which supports wheels 96, thereby driving the latter. This drive is transmitted to wheels 104 by a timing belt 140 so that wheels 104 are synchronized to the wheels 96. Sprocket 134 drives a chain 142 which in turn drives a sprocket 144 secured to shaft 58 which supports the wheels 56, FIG. 1B.

Stream Feed; Loading the Hopper 32

It has already been mentioned that riffling occurs at the two bends around the wheels 56 and 96 and it will be recognized flexing takes place, that is, a bend in one direction around the wheels 56 and a bend in the opposite direction around the wheels 96. There is also considerable jostling of the signatures during their elevated travel from wheel 56 upward to wheel 96 so that by the time the overlapped signatures are moved forward in the direction of the hopper 32 they are quite loose.

As shown in FIG. 7 the signatures are clamped between the belts 44 and 102 during forward travel to hopper 32, and of course the signatures are constantly clamped between feed belts from the time they enter gate 34 until they pass over wheel 104, FIG. 7. During this time the overlap prevails so that during a normal run of the machine there is a tight, continuous stream of shingled sheets.

As shown in FIGS. 5 and 6 the signatures are stacked in the supply hopper 30 with the lap margin LM uppermost and facing the stop plate 42. The backbone BK is always in leading position and in order that the stream movement can be readily visulaized the signatures are numbered in FIGS. 5, 6 and 7.

As the signatures are released and emerge from the bight between feed belts 44 and 102, FIG. 7, they drop (backbone BK downward) on to a set of conveyor belts 150 which receive and advance the signatures forwardly until stopped by the front plate of the hopper 32. At this point, the forwardmost signature in hopper 32 is in position to be unloaded or delivered to a signature gathering chain, not shown. As one signature is released at the bight between opposed rollers 104 and 98 (No. 4, FIG. 7) it is supported by the trailing signature (No. 5) not yet fully released, in turn supported by the next trailing signature (No. 6) which is also near to being released.

Thus, with hopper 32 empty, it will be gradually filled following the first signature to drop, No. 1, and the supply stack in hopper 32 will grow in a rearward direction. To prevent the stack from interferring with free delivery of fresh signatures emerging from between rollers 98 and 104, means are afforded to disable the chain drive when hopper 32 is deemed full. Specifically, a sensing means detects a full hopper, or hopper fulfillment, whereupon clutch 122 is disengaged to prevent gear 120 from being driven.

Referring now to FIG. 1A, a sensing finger 160 is attached at one end to the actuator of a normally closed switch 162. Switch 162 is in the circuit of the solenoid which disengages clutch 122 to disable the drive to the main driving gear 120.

When the stack in hopper 32 reaches rearward to sensing finger 160, it is shifted to open switch 162 to disengage clutch 122, interrupting the drive to chains 136 and 142; all motion ceases, which is to say there is no sheet movement, either through the gate 34 or into hopper 32, until hopper 32 has been unloaded sufficiently to allow the sensing finger 160 to restore to the position where switch 162 again closes to allow the clutch to engage, restoring the normal chain drive.

Since the top-to-bottom dimension of the sheets may vary from one run to the next, means are afforded to vary the drop height of the sheets into the hopper 32, FIG. 1A. This is accomplished by supporting the forward run of the transfer belts 44 and 102 by a cantilever frame, allowing the delivery end of these belts, where rollers 104 are opposed to rollers 98, to be raised or lowered relative to the conveyor belts 150. To this end, a pair of laterally spaced support plates 166, FIG. 2, extend upward from the bed of the machine and are used to support the bearings for shaft 168 which carries roller 96.

A pair of cantilever arms 170 are pivotally supported co-axial with shaft 168. Shaft 172, FIG. 1A, which carries rollers 104, is journalled at the outboard or forward ends of arms 170 and the oposite ends 170E extend rearward of the pivotal axis.

Each arm 170, at the end 170E, is provided with a lug 174, FIG. 2, in which an adjustment screw 176 is rotatably mounted. The threaded shaft of each screw is threadedly mounted in a nut 178 supported by an upwardly extending arm 180, in turn mounted to the frame of the machine. By extending or shortening the screw relative to the nut, the arms 170 may be lowered or elevated, thereby altering the attitude of the forward feed path not only to accommodate signatures of different dimension for the best drop into hopper 32 but also to obtain optimum support of one signature behind another, FIG. 7, as the signatures are fed to the conveyor belts 150.

The Supply Station

Figure 3:
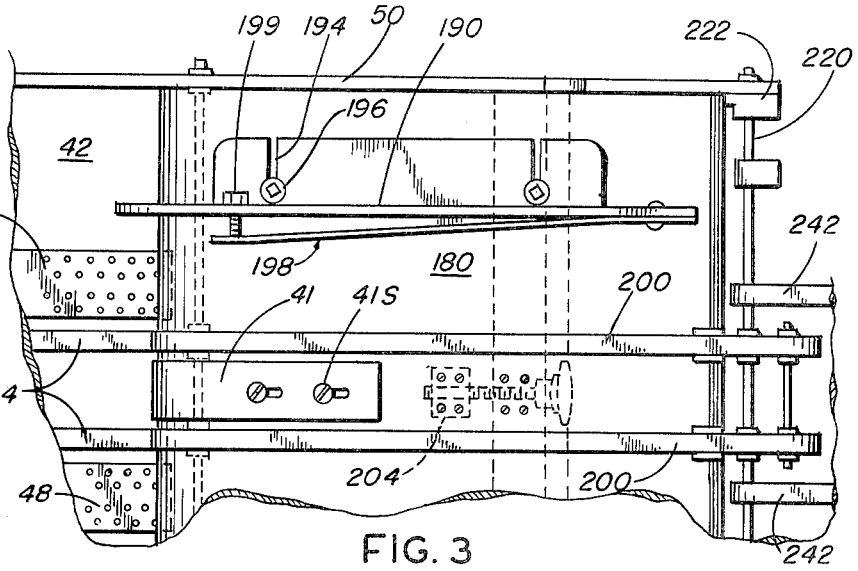
FIG. 3 is a fragmentary plan view of the supply station, taken on the line 3—3 of FIG. 1B.

The machine is loaded at the supply station 30, which is defined by a generally horizontal support plate 180, FIG. 3, which slopes downwardly in the direction of the gate 34 as shown in FIG. 1B.

Plate 180 is located between and supported by the frame side plates 50. To vary the angle of inclination of support plate 180, the frame plates 50 are adjustably mounted on the frame plate 52, FIG. 1B, achieved by (four) adjustment slots 182 and clamps 184; shaft 58 is the center.

The signatures at the supply station, supported on plate 180 in the manner shown in FIG. 5, are confined between a pair of vertical plates as 190, FIGS. 1B and 3, each of which has a bottom flange with slots 194 and clamps 196 for lateral adjustment to neatly confine the signature therebetween. An elongated leaf spring 198 is arranged on the inside face of each plate 190. The leaf spring is secured in place at the aft end; the opposite end is free to flex and is engaged by an adjustment screw 199, whereby the spring may be relaxed (or flexed more) in cooperation with the opposed spring (not shown) to produce a trimmed guide for steering the signatures for accurate parallelism with the stop plate 42.

Means are provided to advance the signature supply toward the stop plate 42, such being manifest in a pair of endless feed tapes or belts 200 travelling lengthwise of the support plate 180. The tapes 200 are aligned with the tapes or belts 44, FIG. 3, and are played around idler rollers 201 and 201A in the manner shown in FIG. 1B. Tapes 200 are driven by rollers (not shown) in turn driven by a sprocket 202 and chain 203, FIG. 1B.

Means are provided to vary the width of the opening or gap into gate 34. This is accomplished by altering the longitudinal position of plate 180, FIG. 1B, which has a lug 204 secured at the under side which receives an adjustment screw 205 mounted in a lug 206 which is carried by a fixed support plate 208 serving as a guide for plate 180.

If the opening leading to gate 34 is narrow, say only wide enough for one signature, then the amount of overlap or shingling will be at the maximum for a given position of the manifold 76. If the opening to the gate 34 is widened by retracting nut 24 by means of screw 205, then, as will be seen in FIG. 6, it is possible for one or more signatures, behind the forwardmost one engaged by the suction belts, to drop downward in gate 34, each under its own weight until it is wedged, so there will be less overlap. In other words, the greater the gap at gate 34, the less the shingle effect because if a signature is allowed to drop by its own weight before being picked up by suction this is the same as grabbing the signature higher by vacuum which, as already explained, results in less overlap. Therefore, the amount of overlap can be determined by adjusting both the manifold and the plate 180.

Any final trimming for the best feed can be accomplished by adjusting the guide 41, FIG. 3, by loosening screws 41S.

Bundle Loading

Means for loading bundles of signatures, which are quite heavy, is shown in FIGS. 11 and 12 which is on a slightly enlarged scale compared to FIG. 1B.

It was mentioned above that there are idlers 201A, FIG. 1B, for the feed tapes 200. These idlers are shown in FIGS. 11 and 12 as rotatably supported on a cross shaft 220 extending between and supported by lugs 222 attached to the side plates 50.

The bundle loader comprises a frame 223 having a cross arm 224 and a pair of spaced parallel arms 226 extending rearwardly therefrom. The arms 226 are spaced by braces 228 and 230. The cross arm 224 is secured to a pair of brackets 232 pivotally mounted in the cross shaft 220 so that the frame may be swung up and down on shaft 220.

Shaft 220 houses a driven shaft 238, FIG. 11, having a sprocket (not shown) driven by a chain 240 in turn driven by a sprocket (not shown) coaxial with sprocket 202, FIG. 1B, for driving a pair of feed tapes 242 supported on frame 223.

Thus, when frame 223 is in the elevated position shown in FIGS. 11 and 12 signatures may be advanced forwardly to the feed tapes 200 travelling on support plate 180.

The bundle loader is held and latched in the elevated position in a manner to be described but it may first be mentioned that by lowering frame 223, substantially to a right angle position as viewed in FIG. 11, a bundle of signatures may be tipped from a truck to lie against the frame 223 whereafter the frame may be elevated manually by a pair of handles 246 secured to the free end of the frame. A stop 248 serves as a rest for the signatures being raised.

The frame 223 is held in its elevated position by an extended arm 252 which may be collapsed to drop the frame. To this end arm 252 at its upper end, FIG. 11, is in effect fastened to the frame 223 and at its lower end is locked by a pivotally mounted latch mechanism 255 such that by releasing the latch arm 252 can be extended through the housing 256 of the latch mechanism; the housing swings clockwise as viewed in FIG. 11 to allow this.

A hollow shaft 258 is pivotally supported by a pair of brackets 262 depending from frame 223. Rod 252 is extended through shaft 258 and has a ball bearing thrust collar 264 pinned thereto to engage an opposed ball bearing thrust collar secured to shaft 258 so that rod 252 may be easily turned (for reasons to be explained) in spite of the weight imposed thereon.

The latch mechanism housing 256 is pivotally mounted in a pair of stub shafts 266 supported by a pair of arms 268 secured to the bed of the machine. Arm 252 is extended through an opening in housing 256.

Arm 252 has a flat notch N1 milled therein, FIG. 11, intermediate its length and has a second notch N2 at the lower end. These notches are latch notches. Thus, a latch lever 270 is pinned to a shaft 272 rotatably mounted in housing 256 and the end thereof opposite latch lever 270 is provided with a ball bearing thrust collar 274 engaged with a like collar at the corresponding end of housing 256 to take the thrust from arm 252.

Latch lever 270 has a latch finger 274, FIG. 11, engaged in notch N2, held there by a spring 276. Spring 276 is anchored at one end to a stud 278 on plate 280 secured to the top side of housing 256 as shown in FIG. 12. The opposite end of the spring is anchored on a stud 282 attached to the latch lever, holding the latch finger in latching position.

By turning arm 252, the notch N2 is displaced from the latch finger, allowing the frame to be lowered, compressing a return spring 284 coiled about arm 252. Rotation of arm 252 is accomplished by turning handle 286, normally located in an index position by a spring 288 acting between a stud 292 on the frame 223 and a like stud on collar 264. The index position is maintained by a stop pin 296 in position to engage an opposed stop pin 298 fixed to collar 264.

The loading platform need not always be used in the loading mode, that is, by lowering it to receive a bundle of signatures. It will be so used, however, in nearly all instances where the signatures are wire bound in a bundle and in those instances the feed tapes 242 will be actuated to feed signatures from loading frame 223 forwardly to the in-feed tapes 200. In other instances, it may be used as a surface on which to "jog" hand-loaded signatures.

It will be seen from the foregoing signatures fresh from the printing press are first stacked edgewise on the in-feed tapes 200 or on the tapes 242 associated with the loading frame 223. To "break" the signatures, that is, to obviate conditions causing the signatures to stick to one another, the signatures are first shingled by being fed in an overlapped relation through gate 34, FIG. 1B, which causes the sheets to slide on one another. The extent of overlap may be varied in the manner explained, either by varying the point where suction is applied to the signature or by varying the gate opening or by both. Thereafter, a continuous shingled stream prevails, FIGS. 6 and 7, and this stream is bent twice (riffled) to assure the desired looseness is attained before the signatures are cascaded off the left end of frame 170, FIG. 1A, to drop one by one into the delivery hopper where they are once again stacked edgewise incidental to delivery onto the gathering chain, not shown.

The sheets (signatures) need not be dropped edgewise into the hopper, FIG. 7, but could be dropped or cascaded flat, one atop another, especially where the hopper supplies a flat or side gatherer, such as the gatherers shown in U.S. Pat. Nos. 3,522,943 and 2,711,896. Also, the signatures during transit need not necessarily be riffled precisely in the manner herein disclosed, but may be riffled (bent) more or less; indeed, during transit, the signatures may be "bent" at an angle less than 90°, once or more than once, and they may be twisted during forward movement just like the aerobatic barrel roll.

A perforated stripper belt of endless form is preferred, feeding the signatures downward, but the belt could feed upwards just as well as long as the overlap is attained.

An endless belt is the preferred stripper device operating on the vacuum principle within the context of the embodiment shown in the drawing where an adjustable manifold is used to "position" the application of the vacuum relative to the vertical dimension of the stack of sheets and thereby determine the amount of overlap which prevails as the sheets move into the gate. However, the same principle could be applied by means of a stripper in the form of a perforated plate or pad which has an adjustable stroke and reciprocates repeatedly to reposition the stripper rather than this being accomplished repetitiously by an endless belt (as shown) following a closed path adjacent the stack of signatures. By the same token, the signature stripper, operating on a vacuum feed principle, could be presented by one or more perforated vacuum discs combined with rotary valves.

We claim:

1. A machine for loading a hopper with sheets while concurrently riffling the sheets, comprising:

(A) a supply station having a support means on which the sheets are to be first stacked on edge, substantially in a front-to-rear horizontal stack;

(B) a stop plate at the front of said support means and cooperating therewith to define a downwardly opening feed gate into which the sheets are to be fed, said plate having a manifold thereon adapted to be connected to a source of vacuum;

(C) a sheet stripper means of endless belt form positioned to traverse said manifold while engaging the leading sheet of the stack, said stripper means having repeating spaced rows of openings therein which, by the motion of the stripper, are successively valved and unvalved to the source of suction as they traverse said manifold, whereby the stripper is effective to extract the leading sheets of the stack successively by a suction grip and advance them one by one into said gate in overlapping relation;

(D) riffle feed belts positioned at the gate to capture the extracted sheets, said feed belts being supported and guided to form a first bend around which the overlapped sheets are fed; and (E) transfer means to transfer the overlapped sheets from said bend to the hopper.

2. A machine according to claim 1 wherein the transfer means (E) includes:

(F) transfer belts extending from said bend and so guided as to turn the overlapped sheets around a second riffle bend before the sheets reach the hopper.

3. A machine according to claim 2 wherein the hopper is located beneath the second riffle bend and wherein the transfer belts are arranged to drop the riffled sheets one by one into the hopper.

4. A machine according to claim 3 wherein the hopper includes means for advancing the sheets to an unloading position and wherein the transfer feed belts drop the riffled sheets one by one thereon.

5. A machine according to claim 4 wherein the transfer belts, beyond the second riffle bend, are supported in a frame to travel in a substantially horizontal path, and (G) adjustable means for said frame enabling the attitude of said path to be varied so that the drop height of the sheets may be varied.

6. A machine according to claim 1 having a drive means including a clutch, and (H) means to sense a full hopper and to disengage the clutch as an incident to hopper fulfillment.

7. A machine according to claim 1 in which the stop plate is provided with openings in spaced rows, said manifold communicating therewith and said manifold being adjustable to communicate with a selected row of openings.

8. A machine according to claim 1 wherein the transfer means (E) include feed belts supported in part by a cantilever frame above the hopper and including adjustable means enabling the frame to be adjusted up and down.

9. A machine according to claim 1 including means to vary the size of the opening into the feed gate.

10. A machine according to claim 5 including means to vary the size of the opening into the feed gate.

11. A machine according to claim 7 including means to vary the size of the opening into the feed gate.

12. A machine according to claim 8 including means to vary the size of the opening into the feed gate.

13. A machine according to claim 1 wherein the support means at the supply station is tilted downwardly toward the gate and is adjustable to vary the tilt.

14. A machine according to claim 5 wherein the support means at the supply station is tilted downwardly toward the gate and is adjustable to vary the tilt.

15. A machine according to claim 8 wherein the support means at the supply station is tilted downwardly toward the gate and is adjustable to vary the tilt.

16. A machine according to claim 9 wherein the support means at the supply station is tilted downwardly toward the gate and is adjustable to vary the tilt.

17. A machine according to claim 1 having (I) a loading bed pivotally attached to said support means and having an elevated position, extending rearward therefrom, to extend the plane of said support means, latch means to hold the bed in said elevated position, and means to release the latch to lower the bed either to an out-of-the-way position or a loading position.

18. A machine for loading a hopper with sheets while concurrently riffling the sheets, comprising:

(A) a supply station having a support means on which the sheets are to be first stacked;

(B) means at one end of said support means cooperating therewith to define a feed gate through which the sheets are to be fed one by one in a substantially vertical attitude;

(C) a sheet stripper belt positioned to traverse both a source of negative pressure and the stack of sheets while engaging the leading sheet of the stack, said stripper belt having repeating spaced rows of openings therein which, by the motion of the stripper, are successively valved and unvalved to a source of negative pressure whereby the stripper is effective to extract the leading sheets of the stack successively by a suction grip applied thereto and advance them one by one into said gate in overlapping relation;

(D) riffle feed means positioned adjacent the gate to capture the extracted sheets, said riffle feed means being supported and guided to form a bend around which the overlapped sheets are fed:

(E) transfer means to transfer the overlapped sheets from said bend to the hopper; and (F) means selectively to vary vertically the point where the suction is applied to the sheets thereby to vary the amount of overlap.

19. A machine according to claim 18 wherein said means (B) is adjustable to vary the size of the gate opening thereby to further vary the overlap.

20. A machine according to claim 18 wherein the transfer means includes transfer belts extending from said bend and so guided as to turn the overlapped sheets around a second riffle bend before the sheets reach the hopper.

21. A machine according to claim 20 wherein the hopper is positioned below the second riffle bend and wherein the transfer belts are arranged to drop the riffled sheets one by one into the hopper.

22. A machine according to claim 21 wherein the transfer belts, beyond the second riffle bend, are supported in a frame to travel in a substantially horizontal path, and adjustable means for said frame enabling the attitude of said path to be varied so that the drop height of the sheets may be varied.

23. A machine according to claim 18 having a drive means including a clutch, and means to sense a full hopper and to disengage the clutch as an incident to hopper fulfillment.

24. A machine according to claim 22 having a drive means including a clutch, and means to sense a full hopper and to disengage the clutch as an incident to hopper fulfillment.

25. A machine according to claim 18 having a loading bed pivotally attached to the end of said support means opposite the gate and having an elevated position, extending rearward therefrom, to extend the plane of said support means, latch means to hold the bed in said elevated position, and means to release the latch to lower the bed either to an out-of-the-way position or a loading position.

26. Apparatus for shingling sheets or signatures to cause them to slide on one another while being fed comprising:

(A) a supply station having a support means on which the sheets are to be first stacked edgewise;

(B) means at one end of said support means cooperating therewith to define a feed gate into which the sheets are to be fed one by one;

(C) a sheet stripper means located on one side of the gate and adapted to communicate negative pressure to the leading sheet of the stack to grab the sheet and move it from the stack into the gate when the stripper means itself is moved accordingly while negative pressure is applied;

(D) means to so move the stripper means along a predetermined path adjacent the stack in the course of communicating negative pressure, and repeatedly so, while negative pressure is applied;

(E) suction means to apply negative pressure so that the sheets are fed through the gate one by one in a shingled relation;

(F) means on the other side of the gate to bend and riffle the sheets and feed the sheets in shingled form to another station;

(G) means to selectively position means (E) to vary the point relative to said path where the negative pressure is applied selectively to grab the sheet high or low relative to said gate thereby to vary the amount of shingle overlap as the sheets are fed into the gate; and said means (B) being adjustable to vary the gate opening dimension accordingly to allow a greater or lesser number of sheets to be presented within the width of the gate opening.

27. A machine for loading a hopper with sheets while concurrently riffling the sheets, comprising:

(A) a supply station having a support means on which the sheets are to be first stacked;

(B) means at one end of said support means cooperating therewith to define a feed gate into which the sheets are to be fed one by one;

(C) a sheet stripper belt positioned to traverse both a source of negative pressure and the stack of sheets while engaging the leading sheet of the stack, said stripper belt having repeating spaced rows of openings therein which, by the motion of the stripper, are successively valved and unvalved to a source of negative pressure whereby the stripper is effective to extract the leading sheets of the stack successively by a suction grip applied thereto and advance them one by one into said gate in overlapping relation;

(D) riffle feed means positioned at the gate to capture the extracted sheets, said riffle feed means being supported and guided to form a bend around which the overlapped sheets are fed;

(E) transfer means to transfer the overlapped sheets from said bend to the hopper; and (F) said means (B) being adjustable to vary the size of the gate opening to vary the overlap.

28. A machine according to claim 27 wherein the transfer means includes transfer belts extending from said bend and so guided as to turn the overlapped sheets around a second riffle bend before the sheets reach the hopper, said hopper being positioned below the second riffle bend, and the transfer belts being arranged to drop the riffled sheets one by one into the hopper.

29. A machine according to claim 28 wherein the transfer belts, beyond the second riffle bend, are supported in a frame to travel in a substantially horizontal path, and adjustable means for said frame enabling the attitude of said path to be varied so that the drop height of the sheet may be varied.

30. Apparatus for shingling sheets or signatures to cause them to slide on one another while being fed comprising:

(A) a supply station having a support means on which the sheets are to be first stacked edgewise;

(B) means at one end of said support means cooperating therewith to define a feed gate opening into which the sheets are to be fed one by one;

(C) a sheet stripper means located on one side of the gate opening and adapted to communicate negative pressure to the leading sheet of the stack to grab the sheet and move it from the stack into the gate opening when the stripper means itself is moved accordingly while negative pressure is applied;

(D) means to so move the stripper means along a predetermined path adjacent the stack in the course of communicating negative pressure, and repeatedly so;

(E) suction means to apply negative pressure so that the sheets are fed through the gate opening one by one in a shingled relation;

(F) means on the other side of the gate opening to bend and riffle the sheets and feed the sheets in shingled form to another station; and (G) said means (B) being selectively adjustable to vary the gate opening dimension so that a wide or narrow gate opening may be selected accordingly to allow a greater or lesser number of sheets to be presented within the width of the gate opening.

31. A machine according to claim 30 wherein the means (G) includes transfer belts extending from adjacent said gate to said other station, said other station including a receiving hopper into which the sheets are dropped.

32. A machine according to claim 31 wherein the transfer belts are supported in a frame to travel in a substantially horizontal path, and adjustable means for said frame enabling the attitude of said path to be varied so the drop height of the sheets may be varied.

* * * * *